US008833101B2

(12) United States Patent
Howes et al.

(10) Patent No.: US 8,833,101 B2
(45) Date of Patent: Sep. 16, 2014

(54) APPARATUS FOR USE AS A HEAT PUMP

(75) Inventors: Jonathan Sebastian Howes, Cambridge (GB); James Macnaghten, Cambridge (GB)

(73) Assignee: Isentropic Ltd., Hampshire (GB)

( * ) Notice: Subject to any disclaimer, the term of this patent is extended or adjusted under 35 U.S.C. 154(b) by 477 days.

(21) Appl. No.: 13/347,350

(22) Filed: Jan. 10, 2012

(65) Prior Publication Data

US 2012/0103004 A1 May 3, 2012

Related U.S. Application Data

(63) Continuation of application No. 11/886,982, filed as application No. PCT/GB2006/001059 on Mar. 23, 2006, now Pat. No. 8,113,011.

(30) Foreign Application Priority Data

Mar. 23, 2005 (GB) ..... 0506006.6

(51) Int. Cl.

| | |
|---|---|
| ***F25D 9/00*** | (2006.01) |
| ***F25D 3/02*** | (2006.01) |
| ***F25B 27/00*** | (2006.01) |
| ***F25B 13/00*** | (2006.01) |
| ***F25B 39/04*** | (2006.01) |
| ***F04B 39/10*** | (2006.01) |
| ***F04B 53/00*** | (2006.01) |
| ***F25B 9/00*** | (2006.01) |

(52) U.S. Cl.

CPC ..... *F25B 9/004* (2013.01)
USPC ..... 62/403; 62/324.1; 62/238.7; 62/98; 62/507; 417/545; 417/555.1; 417/570

(58) Field of Classification Search

CPC ..... F25B 30/06; F25B 2313/0213; F25B 2313/0214; F25B 2313/0215; F25B 230/00; F25B 230/02; F25D 9/00
USPC ..... 62/403, 324.1, 238.7, 98, 507; 545/555.1, 545, 570
See application file for complete search history.

(56) References Cited

U.S. PATENT DOCUMENTS

| | | | |
|---|---|---|---|
| 2,903,862 | A | 9/1959 | Bouchard |
| 3,503,304 | A | 3/1970 | Comeau, Jr. et al. |

(Continued)

FOREIGN PATENT DOCUMENTS

| | | |
|---|---|---|
| CN | 1269866 | 10/2000 |
| CN | 2443279 | 8/2001 |

(Continued)

OTHER PUBLICATIONS

International Search Report and Written Opinion issued in related International Application No. PCT/GB2006/001059, 8 pages.

(Continued)

*Primary Examiner* — Mohammad M Ali
*Assistant Examiner* — Erik Mendoza-Wilkenfe
(74) *Attorney, Agent, or Firm* — Lempia Summerfield Katz LLC

(57) ABSTRACT

Apparatus for use as a heat pump includes compression chamber means, inlet means for allowing gas to enter the compression chamber means, compression means for compressing gas contained in the compression chamber means, heat exchanger means for receiving thermal energy from gas compressed by the compression means, expansion chamber means for receiving gas after exposure to the heat exchange means, expansion means for expanding gas received in the expansion chamber means, and exhaust means for venting gas from the expansion chamber means after expansion thereof.

17 Claims, 7 Drawing Sheets

(56) References Cited

U.S. PATENT DOCUMENTS

| | | | | |
|---|---|---|---|---|
| 4,834,632 | A | 5/1989 | Gatecliff et al. | |
| 4,924,824 | A | 5/1990 | Parsons | |
| 5,295,370 | A | 3/1994 | Morris | |
| 5,449,278 | A | 9/1995 | Lin | |
| 6,308,666 | B1 | 10/2001 | Drecq | |
| 2002/0023449 | A1 | 2/2002 | Park et al. | |
| 2002/0170301 | A1 * | 11/2002 | Loprete et al. | 62/175 |
| 2006/0086110 | A1 * | 4/2006 | Manole | 62/175 |

FOREIGN PATENT DOCUMENTS

| | | |
|---|---|---|
| DE | 19503453 | 8/1996 |
| DE | 199 04 002 | 8/2000 |
| DE | 199 25 445 | 12/2000 |
| DE | 100 25 873 | 11/2001 |
| GB | 240 823 | 5/1926 |
| GB | 569 554 | 5/1945 |
| GB | 2 127 496 | 4/1984 |
| JP | 46-30721 | 9/1971 |
| JP | 01-139958 | 6/1989 |
| JP | 02-055827 | 2/1990 |
| JP | 5-113256 | 5/1993 |
| JP | 7-139461 | 5/1995 |
| JP | 7285842 | 10/1995 |
| JP | 9-503262 | 3/1997 |
| JP | 11-237129 | 8/1999 |
| WO | WO 95/08696 | 3/1995 |

OTHER PUBLICATIONS

Kolin, "The Evolution of the Heat Engine," Longmans, London, two excerpted pages (1972).

Dieckmann et al., "Research and Development of an Air-Cycle Heat-Pump Water Heater," Final Report—U.S. Department of Energy, 13 excerpted pages, including pp. 4-12, 4-14, 4-17, and 5-13 (1979).

Chinese Office Action (and English language summary) issued in corresponding Chinese Application No. 200910211736.2 mailed Aug. 8, 2011; 7 pgs.

* cited by examiner

APPARATUS FOR USE AS A HEAT PUMP

CROSS-REFERENCES TO RELATED APPLICATIONS

This application is a continuation, and claims the priority benefit under 35 U.S.C. §120, of the U.S. non-provisional application entitled "Apparatus for Use as a Heat Pump" and assigned U.S. application Ser. No. 11/886,982, a national stage application that entered the national phase on Oct. 23, 2008, based on International Application No. PCT/GB2006/001059, which was filed on Mar. 23, 2006, and which claimed priority benefit of Great Britain national patent application No. 0506006.6 filed on Mar. 23, 2005, the entire disclosures of which are hereby incorporated by reference.

BACKGROUND OF THE DISCLOSURE

1. Field of the Disclosure

The present invention relates primarily to apparatus for use as a heat pump, and in particular but not exclusively apparatus configured to use atmospheric air as its heat source when operating as a heat pump. In addition, apparatus according to the present invention may also be configured for use as a refrigerator (e.g. air-conditioning unit) or a heat engine.

2. Brief Description of Related Technology

Conventional heat pumps used for heating buildings or the like use a working fluid operating in a closed vapour cycle and generally draw their heat supply from either the ground or a water reservoir, via a heat exchanger. The heat exchangers used in such arrangements are generally separated from the heat pump itself and are often of considerable size, particularly if ground-sourced or requiring a source of still or running water. The working fluid of such devices usually works in a closed cycle and the heat obtained from the heat exchanger is pumped to the thermal load via another heat exchanger. The coolants/refrigerants commonly used as working fluids in such heat pumps are often potential pollutants.

The use of atmospheric air as the heat source in a heat pump is known in the art, but generally requires use of inefficient aerodynamic compressors (or blowers) to handle the high volumetric flows required as a result of the low energy per unit volume of ambient air. The heat exchange elements deployed in such arrangements are also generally vulnerable to ice accretion due to moisture within the air.

SUMMARY OF THE DISCLOSURE

The present applicants have appreciated the need for an improved heat pump which can use atmospheric air as the heat source and which overcomes, or at least alleviates, some of the problems associated with the prior art.

In accordance with a first aspect of the present invention, there is provided apparatus for use as a heat pump comprising: compression chamber means; inlet means for allowing gas to enter the compression chamber means; compression means for compressing gas contained in the compression chamber means; heat exchanger means for receiving thermal energy from gas compressed by the compression means; expansion chamber means for receiving gas after exposure to the heat exchange means; expansion means for expanding gas received in the expansion chamber means; and exhaust means for venting gas from the apparatus after expansion thereof.

The gas may be air from the surrounding atmosphere. In this way, a heat pump is provided in which atmospheric air may be used as both the heat source and as the working fluid (e.g. single phase working fluid). Advantageously, the use of atmospheric air as the working fluid means that there is no need to use potentially polluting coolants. Furthermore, since the heat source and the working fluid may be one in the same, the size and complexity of the heat pump may be considerably reduced. For example, the heat pump may be configured such that a substantial proportion of the overall volume of the device is thermodynamically active. In this way, the heat pump may be housed in a single compact unit configured for ease of installation. Furthermore, since all heat exchange may occur within the unit itself, the present invention does not require a large complex heat exchanger.

The compression may be substantially isentropic or adiabatic. The heat exchange may be substantially isobaric. The expansion may be substantially isentropic or adiabatic.

The inlet means may comprise at least one inlet aperture in fluid communication with the compression means. For example, the compression means may be housed in a casing and the inlet means may comprise an array of apertures in the casing. The array of apertures may in use be located at a lower part (e.g. base) of the casing. Alternatively, the array of apertures may in use be located at an upper part (e.g. top face) of the casing The inlet means may further comprise at least one inlet valve for controlling ingress of gas into the compression chamber means. When actuated, the at least one inlet valve may be configured to seal the or a respective inlet aperture. The at least one inlet valve may be a non-return valve. The at least one inlet valve may comprise a passively-controlled inlet valve. For example, the at least one inlet valve may comprise a pressure-activated inlet valve (e.g. a reed valve, or plate valve). The inlet valve may be configured to be held lightly closed when sealing its respective aperture. The at least one inlet valve may be configured to remain closed whilst the or a respective delivery valve is open (see below). In another embodiment, the at least one inlet valve comprises an actively-controlled inlet valve (e.g. a plate valve or a rotary valve). The at least one inlet valve may be configured to open when pressure on either side of the valve is equalised.

Alternatively, the at least one valve may comprise a passageway extending from the at least one inlet aperture, and a member configured to be freely moveable along a section of the passageway between a first position blocking the at least one inlet aperture and a second position spaced from the inlet aperture. In this way, a valve (hereinafter referred to as a "ball valve") may be provided in which movement of the member may be activated automatically by a pressure difference across the member. The member may be substantially spherical (hereinafter referred to as a "ball member"). The member may be formed from plastics material.

Advantageously, the distance between the first and second position for a ball member need only be half the diameter of the ball. Thus, in the case of a ball having a diameter of 3 mm, the ball only needs to be displaced 1.5 mm to fully seal/unseal the inlet. In this way, only a very small amount of space is required in the compression chamber means to accommodate movement of the ball. Furthermore, since the ball member is light and moves by only a small distance, the ball valve may be operated quietly even when opening and closing 1500 times per minute. In one specific embodiment, the inlet means comprises 3000 of such ball valves, with each ball formed from plastics material having a low specific gravity. In this way, a valve is provided in which the moveable part (i.e. the balls) has a low inertia compared to a convention metal plate valve.

The compression means may comprise compression piston means for compressing gas contained in the compression chamber means. The compression piston means may be coupled to driving means for driving the compression piston means in the compression chamber means to compress gas contained therein.

The compression piston means may have an effective piston diameter to piston stroke length ratio of at least 2:1. Advantageously, such a ratio allows near isentropic compression (and hence high cycle efficiency) since, although the piston means has a higher surface area per unit volume of gas compressed than a conventional piston with more equal dimensions, the gas in contact with the piston face is effectively near stagnant whereas the cylinder walls experience gas in unavoidable motion and this wall area is reduced in proportion by such a configuration. Reducing the area of the cylinder wall when compared with that of the piston therefore minimises flow of the gas across conductive surfaces.

Other advantages of such a ratio include:

i) a relatively large mass of air may be moved at a low velocity;

ii) there are lower mechanical losses as the piston has less far to move;

iii) there are lower frictional losses in seals associated with the compression piston means as the piston has less far to travel and/or each seal serves more air per cycle for a given stoke.

iv) leaks in peripheral seals associated with the compression piston means have less effect than they would in a piston of conventional proportions.

In the case of a 2:1 piston diameter to piston stroke length, the ratio of piston face area to cylinder wall area is 1:1. In contrast, in a normal diesel engine, the piston diameter to piston stroke length is around 1:1 and the ratio of piston face area to cylinder wall area is 1:2. In one embodiment, the effective piston diameter to piston stroke length ratio is at least 3:1.

In another particularly advantageous embodiment, the effective piston diameter to piston stroke length ratio is at least 4:1. It has been found that a ratio of 4:1 or more provides a notable improvement in efficiency over a piston of conventional proportions. For example, the effective piston diameter may be around 500 mm and the effective stroke length between 30 and 70 mm.

The compression piston means may comprise a single compression piston. For balanced operation, the single compression piston may be configured to operate in anti-phase (i.e. 180 degrees out of phase) with a counterweight. Alternatively, the compression piston means may comprise a plurality of compression pistons. In this way, the mass and load forces acting on the piston means may be more readily balanced. In the case of a plurality of compression pistons, the effective piston diameter to piston stroke length ratio is defined as the ratio of the combined effective piston diameter to the mean piston stroke length.

In the case of a plurality of compression pistons, two or more of the pistons may be configured to move out of phase. Each piston may, for example, lag behind a neighbouring piston by an equal interval. For example, in the case of n pistons, each piston may be (1/n)*360 degrees out of phase with an adjacent piston. In this way, a more constant force loading is experienced by the driving means, thereby reducing the need for flywheels and allowing the use of a single high speed (constant power) electric motor. It also allows additional compressor/expander modules to be readily added to the apparatus if more power is required.

In one embodiment, the plurality of pistons are laterally spaced along an axis. In another embodiment, the plurality of pistons are spaced circumferentially around a central axis. For example, the compression pistons means may comprise a pair of diametrically opposed pistons (e.g. a boxer-type arrangement). The opposed pistons may be configured to compress separate volumes of gas. In one embodiment, the opposed compression pistons operate in anti-phase. In this way, the action of the pistons may be balanced.

In the case of compression piston means comprising a single compression piston, the compression chamber means may comprise a single compression chamber for receiving the single compression piston. In the case of compression piston means comprising a plurality of compression pistons, the compression chamber means may comprise a plurality of discrete compression chambers, each associated with a respective compression piston. Each compression chamber may have at least one respective inlet valve.

The or each compression piston may be moveable from a first position to a second position, with compression of gas contained in the or each respective compression chamber occurring as the or each compression piston moves from the first position to the second position. The inlet means may be configured to allow gas to enter the or each compression chamber as the or each respective compression piston moves to the first position. For example, at least one inlet valve may be configured to open when the or a respective compression piston moves from the second position to the first position (e.g. after a previous compression stage). Once gas has entered the or each compression chamber, the compression chamber is sealed (e.g. by closing the at least one inlet valve) and the or each respective compression piston is moved by the driving means from the first position to the second position to compress the gas.

The driving means may comprise a mechanically linked driving mechanism. In another version, the driving means may comprise a non-mechanically linked driving mechanism (e.g. an electromagnetic drive).

Once gas has been compressed by the compression means, the gas (which should now have a temperature elevated above its inlet temperature by virtue of the compression) is ready to be exposed to heat exchanger means. In one embodiment, the or at least one compression piston may comprise one or more apertures each with a delivery valve for allowing gas to pass through the or the least one piston from the or its respective compression chamber to the heat exchanger means. The or each aperture may be located on a working face of the or the at least one compression piston. By providing the aperture(s) through the working face of the piston(s), the area of the compression piston means available for valve means is maximised. With a conventional design of compressor where the valve means is located entirely in a cylinder head, only about half of the area of the cylinder head is available for providing ingress and half for delivery. The compression piston means of the present invention may provide about twice as much valve area for a given bore of conventional compressor.

The or each delivery valve may be configured to seal the one or more compression piston apertures as the or the at least one compression piston starts to move from the first position to the second position. In one version, the or each delivery valve may comprise a pressure-activated valve (e.g. a perforated reed valve, a ball valve, a plate valve, or a rotary valve) which is closed as the or the at least one piston moves from the first position towards the second position. The or each pressure-activated valve may be configured to close as a result of gas pressure within the heat exchange means which may be above the pressure of gas in the compression chamber associated with the compression piston or the at least one compression piston for most of the compression stage. Once the pressure of gas in the or the respective compression chamber is equal to or greater than the gas pressure within the heat exchange means, the or each pressure-activated valve may be configured to open and the compressed gas may be delivered to the heat exchange means.

The heat exchanger means may comprise a thermally conductive body for housing a load fluid, the thermally conductive body being configured to encourage transfer of heat from the compressed gas to the load fluid. For example, the thermally conductive body may have a high surface area to volume ratio. In this way, the heat exchanger may extract heat from relatively low temperature gas. The heat exchanger means may be housed in a sealable chamber.

The heat exchanger means may be configured to remove water vapour from the compressed gas. In this way, water in the gas may be removed before the subsequent expansion stage to minimise formation of ice in the exhaust means.

The heat exchanger means may have a large cross-sectional area permitting a high mass, low velocity gas flow. Advantageously, such a flow maximises exposure time of the gas to the heat exchanger means to allow increased condensation of water vapour. For example, the heat exchanger means may be optimised or configured to accept a gas flow rate of 5 meters per second or less. The need for such a low velocity is to ensure that condensate does not get blown through to the expansion means but instead settles on surfaces of the heat exchanger means. In one embodiment, the heat exchanger means is configured to accept a gas flow rate of 3 meters per second or less. In another embodiment, the heat exchanger means is configured to accept a gas flow rate of between 1.5 to 2 meters per second.

The heat exchanger means may comprise a collection trap for collecting condensed water. As gas cools within the heat exchanger means, any water vapour contained within the gas may condense. The heat exchanger may be configured to direct condensates into the collection trap. Water collected in the collection trap may be ejected by means of a float valve or other water-sensing valve once the water level has reached a threshold value.

In some situations, it may not be possible to remove all of the water content of the air prior to expansion and thus some ice accretion within the expander may be likely to occur. In one embodiment, some of the heat output from the heat pump is used in an occasional de-ice cycle. In another embodiment, additional moisture is removed from the gas in the heat exchanger means by providing a further heat exchanger after the first-mentioned heat exchanger means, but prior to the expansion means, that is cooled by the air leaving the apparatus through the exhaust means. The overall coefficient of performance is likely to be reduced by the second heat exchanger means, but the operation of the heat pump should not be unduly compromised since additional pre-expansion cooling should not be needed at all times and should be regulated such that any additional pre-expansion cooling of the air is limited to that degree necessary for moisture extraction only.

In one version, the heat exchanger means may further comprise a heat transfer fluid surrounding (at least partially) the thermally conductive body, and means for passing the compressed gas through the fluid, whereby thermal energy is transferred from the compressed gas to the heat transfer fluid. In turn, thermal energy is transferred from the heat transfer fluid to the thermally conductive body to maximise the proportion of heat that is transferred to the load fluid. For example, the means for passing the compressed gas through the fluid may comprise a foramenous (e.g. perforated) screen. The foramenous screen may be configured to generate a bubble structure within the fluid, the bubble structure having a very high surface-area to volume ratio. The foramenous screen may be positioned between the compression means and the thermally conductive body. The heat transfer fluid may be a liquid, and may be chosen to have a viscosity suitable for carrying bubbles created by gas flowing through the foramenous screen. The heat transfer fluid may comprise an oil (e.g. silicone oil). The heat transfer fluid may be chosen to be immiscible with water, have a lower density than water, and have a self ignition temperature which is higher than the temperature of the pressurised gas passing therethrough. In order to maintain an output of fine bubbles, more than one foramenous screen may be deployed. In another version, the load fluid may be the heat transfer liquid, thereby avoiding the need for the thermally conductive body.

The means for passing the compressed gas through the fluid may be configured to produce a gas flow which is concentrated around a localised region in the heat exchanger means (e.g. a flow path which is stronger in a central part of the heat exchanger means than in peripheral parts thereof) and may be configured to direct condensates formed in the heat exchanger means towards the collection trap. For example, the means for passing the compressed gas through the fluid may comprise a foramenous screen having a convex or conical body including an apex which is, in use, above the collection trap. In one embodiment, the collection trap may comprise a peripheral collection trap. In addition, the heat transfer fluid may be selected to have a lower density than the condensate, thereby encouraging the condensate to be displaced away from the localised gas flow and towards regions where the bubble path is less concentrated where the condensate can fall and be collected in the collection trap.

If a heat transfer liquid is used, liquid may leak down past the compressor valves during periods when the compression means is idle. Such liquid may be contained within the casing and the liquid may be pumped back by the compressor stage on start up.

The expansion means may comprise an expansion piston means. The expansion piston means may comprise a single expansion piston (e.g. when the compression piston means comprises a single compression piston). For balanced operation, the single expansion piston may be configured to operate in anti-phase with a counter weight. Alternatively, the expansion piston means may comprise a plurality of expansion pistons (e.g. when the compression piston means comprises a plurality of compression pistons). In the case of a plurality of expansion pistons, two or more of the pistons may be configured to move out of phase. For balanced operation, opposed pairs of expansion pistons may operate in anti-phase.

In the case of expansion piston means comprising a single expansion piston, the expansion chamber means may comprise a single expansion chamber for receiving the single expansion piston. In the case of expansion piston means comprising a plurality of expansion pistons, the expansion chamber means may comprise a plurality of discrete compression chambers, each associated with a respective expansion piston.

The or at least one expansion piston may move in sympathy with the or a respective compression piston. The or at least one expansion piston means may have a piston stroke length that corresponds to that of the or a respective compression piston. In one embodiment, the or the at least one expansion piston has an effective piston diameter to piston stroke length ratio that is equal to that of the or a respective compression piston (e.g. at least 2:1, at least 3:1 or at least 4:1).

The or at least one expansion piston may be moveable from a first position to a second position, with expansion of gas contained in the or a respective expansion chamber occurring as the gas does work to help move the or the at least one expansion piston from the first position to the second position. In this way, some of the original energy of compression contained in the processed gas may be recovered and may be used to assist with the work of the compression stage.

In the first position, the or each expansion piston may be configured to allow gas to enter the or a respective expansion chamber (after the gas has been exposed to the heat exchanger means). For example, the or at least one expansion piston may comprise one or more apertures, each with a mechanically driven inlet valve (hereinafter referred to as the "expansion inlet valve") for allowing gas to pass through the or the at least one expansion piston from the heat exchanger means to the or a respective expansion chamber. The or each aperture may be located on a working face of the or the at least one expansion piston. By providing the apertures(s) through the working face of the pistons(s), the area of the expansion piston means available for valve means is maximised.

The or each expansion inlet valve may be configured to allow gas to flow through its respective expansion piston aperture as the or the at least one compression piston moves into the first position.

In one embodiment, the or at least one expansion inlet valve may be disposed on an underside of the or the at least one expansion piston and the expansion means may comprise a protuberant part registrable with an aperture in the or the at least one expansion piston and configured to force the expansion inlet valve open when the protuberant part comes into contact with the expansion inlet valve as the or the at least one expansion piston moves to the first position, and which allows the expansion inlet valve to close as the or the at least one expansion piston moves towards the second position. The protuberant part may be adjustably mounted relative to the or the at least one expansion chamber. In this way, the proportion of stroke over which the expansion inlet valve is open may be controlled. For example, the protuberant part may be resiliently biased to maintain a predetermined position relative to an adjustable abutment part. For example, the protuberant part may be coupled to a spring. A plurality of protuberant parts may be provided to supply a plurality of actuation loads to the or each expansion inlet valve.

In another embodiment, the or at least one expansion inlet valve may comprise a rotary valve. The rotary valve may comprise a plate rotatably coupled to a face (e.g. a rear face) of the or the at least one expansion piston, the plate comprising at least one aperture for registering with the or each aperture of the or the at least one expansion piston. The plate may be rotatable relative to the or the at least one piston between a first position in which the aperture(s) on the plate and expansion piston are registered, to a second position in which the apertures are no longer registered to any degree. The rotary valve may be configured to oscillate between first and second positions separated by a small angle (e.g. 5 to 10 degrees). In the second position, the plate may be configured to be urged against a face (e.g. a rear face) of the or the at least one expansion piston.

The rotary valve may comprise spacing means for reducing friction and/or varying spacing between the plate and a face of the or the at least one piston during valve operation. In this way, the potential for the plate and piston face to lock up as a result of the pressure of air passing through the at least one aperture is minimised. The spacing means may comprise a member configured to rotate when the plate rotates relative to the piston face. For example, the member may comprise a roller bearing or a ball bearing. In one embodiment, the member is configured to engage a tapered profile, the direction of the taper being such as to cause separation of the plate and piston face as the plate moves from the second position to the first position. The tapered profile may comprise a tapered groove. The tapered profile may be located on the piston face and the member may be located on the plate (or vice versa). Advantageously, the plate does not need to move far between the first and second positions (so the valve is relatively quiet) and the valve is relatively easy to control (especially at high speeds) as the plate is stiff in the horizontal axis. In another embodiment, the spacing means comprises spring means (e.g. leaf spring means).

The expansion inlet valve(s) may be operated by one or more of: pressure; mechanical actuation, electromagnetic actuation, hydraulic actuation or by any other suitable means. In one embodiment of the present invention, the compression piston means and the expansion piston means may be coupled together to work in synchrony. For example, in the case of a single compression piston and a single expansion piston, the pistons may be connected together (e.g. rigidly) by connection means (e.g. interconnecting struts). In the case of a plurality of compression pistons and a plurality of expansion pistons, pairs of compression and expansion pistons may be connected together. In this way, the expansion stage may be used to assist with the work of the compression stage and reduce (e.g. significantly reduce) the work per cycle of the apparatus. The main benefits of having such a piston arrangement are:

i) energy returned during expansion can be used directly to aid that required during compression;

ii) it helps to stabilise the two pistons faces;

iii) it allows for a lightweight piston structure that can cope with the high loads imposed upon it; and iv) the loads are generally reduced as they can often be cancelled by external pressure at certain points in the cycle.

In another arrangement, pairs of compression pistons may be connected together (e.g. rigidly). Alternatively, or in addition, pairs of expansion pistons may be connected together (e.g. rigidly). The above advantages ii)-iv) apply for such compressor-compressor pairs; advantages i)-iv) apply for such expander-expander combinations.

As the compression and expansion chambers may be of large diameter and short stroke (e.g. in the order of 0.6 m and 0.03 m respectively), the region between the pistons may be used to house the heat exchanger means. In this way, a highly compact heat pump may be obtained which may be readily mounted in or adjacent a wall of a domestic building. However, in another embodiment the heat exchanger means may be located outside of the region between the pistons. The main benefits of having a separate heat exchanger that is not situated in the space directly between the pistons are:

i) it allows for a much lighter and less complicated arrangement of pistons;

ii) it allows for a much simpler heat exchanger as there is no need for the heat exchanger to accommodate interconnecting rods;

iii) it allows for much greater flexibility in physical layout of components;

iv) it allows a plurality of compression pistons and expansion pistons to share one heat exchanger;

v) it allows the possibility of using the working fluid as a direct form of heating, for example by providing a radiator designed to use heated compressed air to effectively provide one large heat exchanger spread over a building.

The exhaust means may comprise one or more outlet apertures in fluid communication with the expansion chamber means and may comprise an exhaust valve (e.g. rotary valve of the type defined above) for controlling escape of gas through the one or more outlet apertures. The exhaust valve may be mechanically actuated and may be closed for most of the compression/expansion stages. For example, the exhaust valve may be actuated in dependence upon movement of the compression means (e.g. via a cam rotating with the driving means controlling the compression means). The expansion inlet valve actuation means may be configured to allow the pressures within the expansion chamber means and the heat exchanger means to substantially equalise prior to opening of the expansion inlet valve. The exhaust valve may be closed for most of the expansion/compression stroke. As the pressure in the expansion chamber equalises with a base pressure (e.g. atmospheric pressure), the exhaust valve may be configured to allow the pressure within the expansion chamber to remain substantially at a base or atmospheric pressure for the remainder of the expansion stroke. For example, the exhaust valve may be configured to open as the pressure in the expansion chamber equalises with the base or atmospheric pressure. In this way, reduction of pressure below atmospheric pressure as a result of over-expansion of the working gas (which may cause a sudden inefficient pressure rise when the exhaust valve is opened) may be avoided.

The exhaust means may be located at one end of the heat exchanger means and the inlet may be located at an opposed end thereof. In this way, contact between the air and the heat exchanger means may be maximised during flow between the inlet and the exhaust means.

In one embodiment, the inlet means may be located adjacent (e.g. above) the driving means for driving the compression piston. In this way, the heat pump may operate using air that is slightly above ambient temperature.

Use as an Air Conditioning Unit.

Apparatus according to the first aspect of the present invention may also be used as an air conditioning unit. For example, the inlet and exhaust may comprise bifurcated ducts, each duct having a limb for drawing/releasing air inside and outside a building. A valve (e.g. a flap valve) may be used to vary the proportion of air taken in from the building and the exterior of the building, and also the proportion of air exhausted to the building and the exterior of the building. To cool a building, air would enter the pump from within the building, initially heated by compression, lose energy to the load fluid (as previously described) and then expanded (and hence cooled) and returned to the building. The load fluid may be cooled using an external heat exchanger or, in another embodiment, it could simply be poured away. For example, if the load fluid is water, a local swimming pool, lake or river may be used as both a water supply and heat dump.

Use as a Heat Engine.

Apparatus according to the first aspect of the present invention will generally have a very high percentage of overall volume available as thermodynamically active volume. Accordingly, and since the apparatus may handle large amounts of power at modest temperature differentials, apparatus according to the present invention may be configured to operate as an effective low temperature differential heat engine. In this mode of operation, atmospheric air would enter the compression stage, be compressed, transferred to the heat exchanger means, be heated by what used to be the load fluid but is now the heat supply, and then be expanded through the expansion means. The expansion means may be configured to have a larger expansion chamber than in the corresponding heat pump version as the specific volume now increases through the device. However, the apparatus is essentially the same.

The ideal cycle thermal efficiency of the heat engine is simply the inverse of the coefficient of performance of a heat pump working over the same temperature range. In this way, there is provided an effective way of extracting further energy from low grade heat. Such an arrangement could, for example, be used to replace a cooling system of a power station and extract further energy in the process.

In accordance with a second aspect of the present invention, there is provided apparatus for use as a heat pump comprising a heat exchanger comprising a chamber for receiving pressurised gas, the chamber comprising a heat transfer fluid and means for passing the compressed gas through the heat transfer fluid, whereby thermal energy is transferred from the compressed gas to the heat transfer fluid.

The means for passing the compressed gas through the heat transfer fluid may comprise a foramenous (e.g. perforated) screen. The heat transfer fluid may be a liquid, and may be chosen to have a viscosity suitable for carrying bubbles created by the pressurised gas passing through the foramenous screen. The heat transfer fluid may comprise an oil (e.g. silicone oil). The heat transfer fluid may be chosen to be immiscible with water, have a lower density than water, and have a self ignition temperature which is higher than the temperature of the pressurised gas passing therethrough. In order to maintain an output of fine bubbles, more than one foramenous screen may be deployed.

In one version the heat exchanger means may comprise a thermally conductive body for housing a load fluid, the thermally conductive body being configured to encourage transfer of heat from the heat transfer liquid to the load fluid. For example, the thermally conductive body may have a high surface area to volume ratio.

In another version, the load fluid may be the heat transfer liquid, thereby avoiding the need for the thermally conductive body.

As gas cools within the heat exchanger means, condensates (e.g. water) may be formed in the heat exchanger means. The means for passing the compressed gas through the heat transfer fluid may be configured to produce a gas flow which is concentrated around a localised region in the heat exchanger means (e.g. a gas flow which is stronger in a central part of the heat exchanger means than in peripheral parts thereof) and may be configured to direct condensates formed in the heat exchanger means towards a peripheral collection trap. For example, the means for passing the compressed gas through the heat transfer fluid may comprise a foramenous screen having a convex or conical body including an apex which is, in use, above the peripheral collection trap. In addition, the heat transfer fluid may be selected to have a lower density than the condensate, thereby encouraging the condensate to be displaced away from the localised gas flow and towards regions where the gas flow is less concentrated where the condensate can fall and be collected in the peripheral collection trap.

Water collected in the peripheral collection trap may be ejected by means of a float valve or other water-sensing valve once the water level has reached a threshold value.

In accordance with a third aspect of the present invention, there is provided apparatus for use as a heat pump comprising: inlet means for allowing atmospheric air to enter a compression chamber; compression means for compressing atmospheric air contained in the compression chamber; heat exchanger means for receiving thermal energy from atmospheric air compressed by the compression means; and exhaust means for venting atmospheric air from the apparatus once thermal energy has been transferred to the heat exchanger means.

In accordance with a fourth aspect of the present invention, there is provided a valve comprising a first part having a first aperture and a second part having a second aperture, the first part being rotatable relative to the second part between a first position in which the first and second apertures are not registered to prevent passage of a fluid and a second position in which the first and second apertures are registered to allow passage of fluid, wherein the valve further comprises spacing means for varying spacing between the first and second parts during valve operation.

The spacing means may be configured to allow the first and second parts to be urged together as the first part moves into the second position. In this way, the potential for the two parts to lock up as a result of the pressure of fluid passing through the first and second apertures may be minimised. The first part may be substantially plate-like.

The spacing means may comprise a member configured to rotate when the first part rotates relative to the second part. For example, the member may comprise a roller bearing or a ball bearing. In one embodiment, the member is configured to engage a tapered profile, the direction of the taper being such as to cause separation of the first and second parts as the first part moves from the second position to the first position. The tapered profile may comprise a tapered groove. The tapered profile may be located on the second part and the member may be located on the first part (or vice versa). Advantageously, the first part does not need to move far between the first and second positions (so the valve is relatively quiet) and the valve is relatively easy to control (especially at high speeds) as the first part is stiff in the horizontal axis.

In another embodiment, the spacing means comprises spring means (e.g. leaf spring means).

BRIEF DESCRIPTION OF THE DRAWING FIGURES

Embodiments of the present invention will now be described by way of example with reference to the accompanying drawings in which.

DETAILED DESCRIPTION OF THE DISCLOSURE

Figure 1:
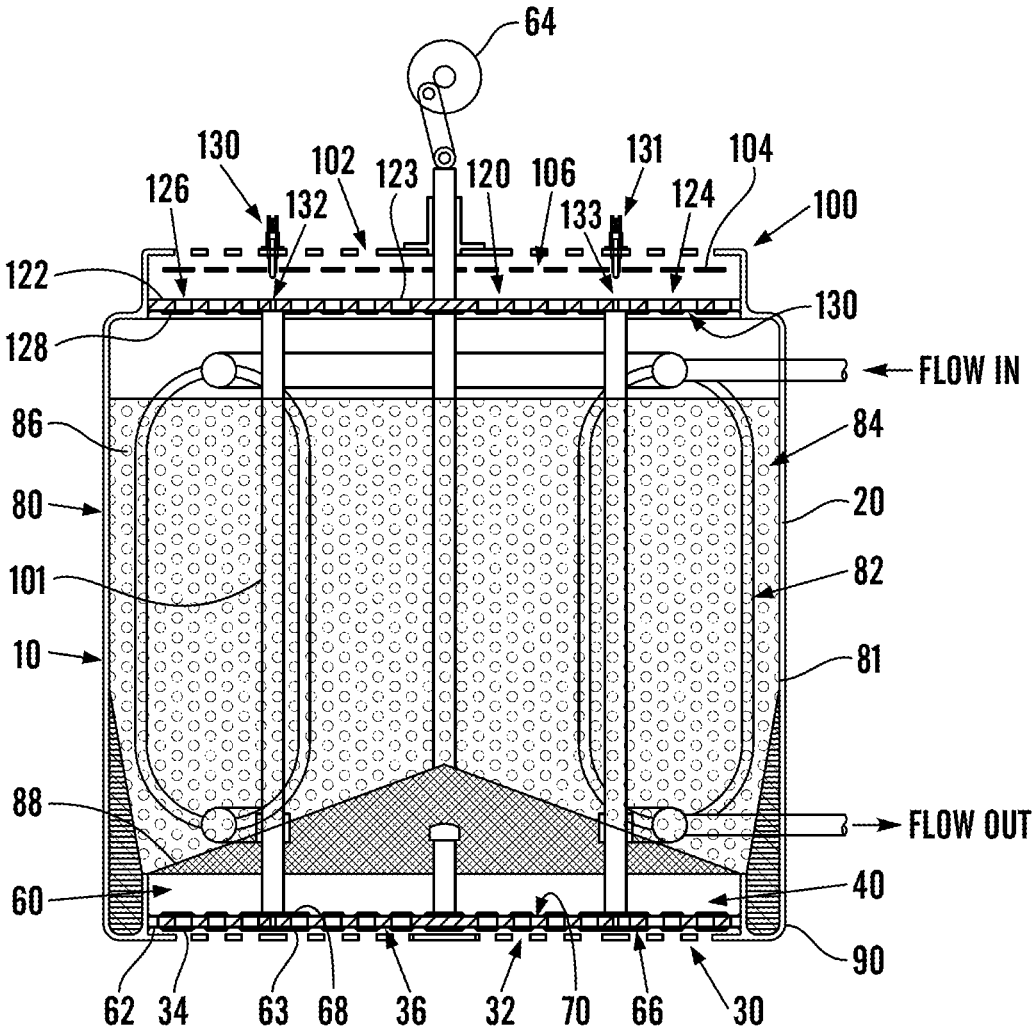
FIG. 1 shows a schematic cross-sectional view of a first heat pump embodying the present invention.

FIG. 1 shows a heat pump 10 comprising a body 20 including: inlet means 30; a compression chamber 40; compression means 60; heat exchanger means 80; an expansion chamber 124; expansion means 120; and exhaust means 100.

Inlet means 30 comprises a plurality of inlet apertures 32 and an inlet valve 34. Inlet valve 34 includes a plurality of inlet valve apertures 36, offset relative to the inlet apertures 32, whereby the inlet apertures 32 are sealed as the inlet valve 34 is moved to obstruct inlet apertures 32. Inlet valve 34 may be a pressure-actuated valve (e.g. a perforated reed valve).

Compression means 60 comprises a compression piston 62 coupled to a driving mechanism 64. Compression piston 62 is slidably mounted in compression chamber 40 and configured to compress gas contained therein. Compression piston 62 has a working face 63 which includes apertures 66 and a delivery valve 68 disposed on a top surface thereof for controlling gas flow through the piston apertures 66. Delivery valve 68 comprises a plurality of delivery valve apertures 70, offset relative to the piston apertures 66, whereby apertures 66 are sealed as the delivery valve 68 is moved to obstruct the delivery apertures 66. Delivery valve 68 may be a pressure-actuated valve (e.g. a perforated reed valve).

In use, air entering the heat pump via inlet means 30 is allowed to pass into the compression chamber 40. Once air has entered the compression chamber 40, the inlet apertures 32 are sealed by inlet valve 34 and the compression piston 62 is then actuated (with piston apertures 66 sealed by gas pressure within the heat exchange means 80) by driving mechanism 64. Once air contained in the compression chamber has been compressed by the compression means 60 up to approximately the level in the heat exchanger means 80, the gas is transferred to heat exchanger means 80 by opening delivery valve 68.

Heat exchanger means 80 comprises a heat exchanger chamber 81 housing a thermally conductive body 82 surrounded by heat transfer liquid 84 (e.g. oil). Thermally conductive body 82 comprises a network of pipes 86 defining a pathway for guiding flow of a load fluid therethrough. The heat exchanger means 80 also includes a conical foramenous screen 88 positioned between the compression means 60 and the thermally conductive body 82, the foramenous screen 88 being configured to encourage the formation of bubbles as the compressed air leaves the compression means 60 and enters the heat transfer liquid 84. The heat transfer means is chosen to have a viscosity suitable for propagating bubbles created by the foramenous screen 88. A collection trap 90 is provided around the periphery of the base of the body 20 to collect condensates formed in the heat exchanger means as the air cools. Water collected in the peripheral collection trap may be removed by means of a float valve or other water-level sensing valve (not shown).

Expansion means 120 comprises an expansion piston 122, rigidly coupled to compression piston 62 by means of interconnecting struts 101, and slidably mounted in expansion chamber 124. Expansion piston 122 has a piston face 123 comprising a plurality of apertures 126 and an expansion inlet valve 128 disposed on a underside thereof for controlling gas flow through the expansion piston apertures 126. Expansion inlet valve 128 comprises a plurality of apertures 130, offset relative to apertures 126, whereby apertures 122 are sealed as the expansion inlet valve 128 bears against the expansion piston 122. The expansion inlet valve 128 is configured to allow air to flow through the expansion piston apertures 126 as the expansion inlet valve 128 is displaced from the expansion piston apertures 126 by means of protuberant parts 130, 131 or (in another version) by pressure from the expansion means.

Figure 3:
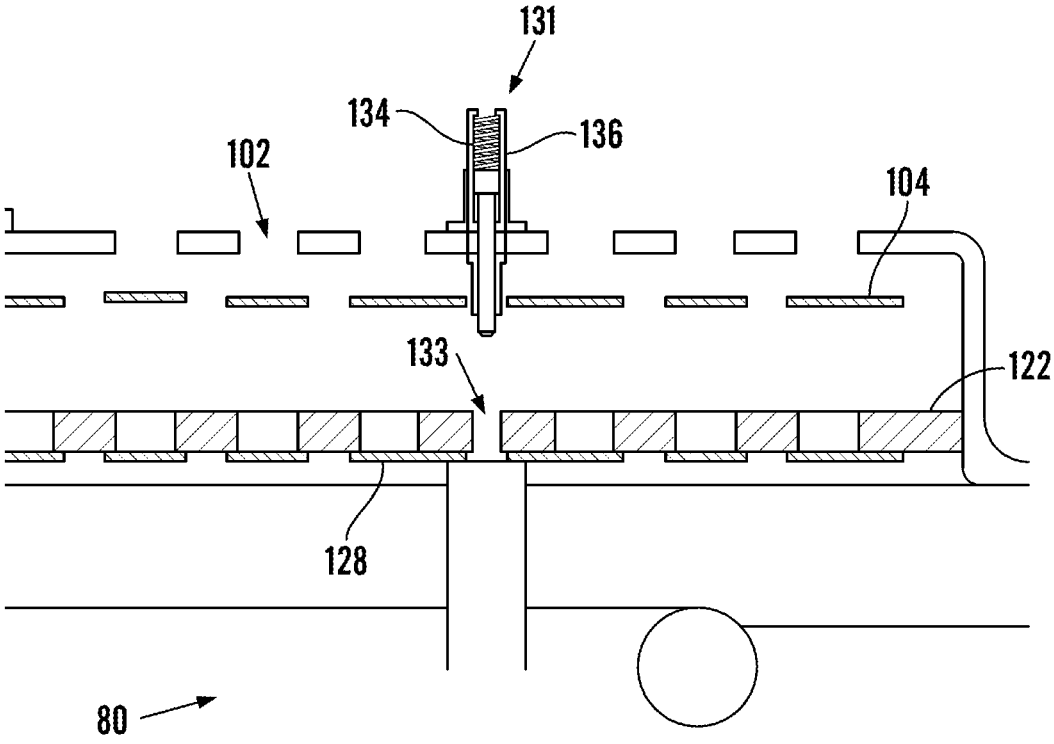
FIG. 3 shows schematic details of exhaust means deployed in the heat pump of FIG. 1.

As can be seen from FIGS. 1 and 3, protuberant parts 130, 131 are registrable with apertures 132, 133 respectively in the expansion piston 122. Protuberant parts 130, 131 are configured to urge the expansion inlet valve 128 away from a central portion of the expansion piston 122 as the expansion piston 122 moves towards the outlet apertures 102, whilst allowing the expansion inlet valve 128 to reseal the expansion piston apertures 122 as the piston begins to move to towards the heat exchanger means 80. Expansion inlet valve 128 is biased to maintain its closed position by a light spring.

Protuberant parts 130, 131 are resiliently biased by springs 134 to increase the length of stroke available whilst the expansion inlet valve is open. The proportion of stroke over which the expansion inlet valve 128 is open may be adjusted by varying the position of the spring by sliding plunger adjuster barrel 136.

Exhaust means 100 comprises a plurality of outlet apertures 102 and a mechanically actuated exhaust valve 104. Exhaust valve 104 includes a plurality of exhaust valve apertures 106, offset relative to the outlet apertures 102, whereby the outlet apertures 102 are sealed as the exhaust valve 104 is moved to obstruct outlet apertures 102. The exhaust valve 104 may be mechanically actuated via a cam (not shown) which rotates in sympathy with driving mechanism 64.

Figure 2:
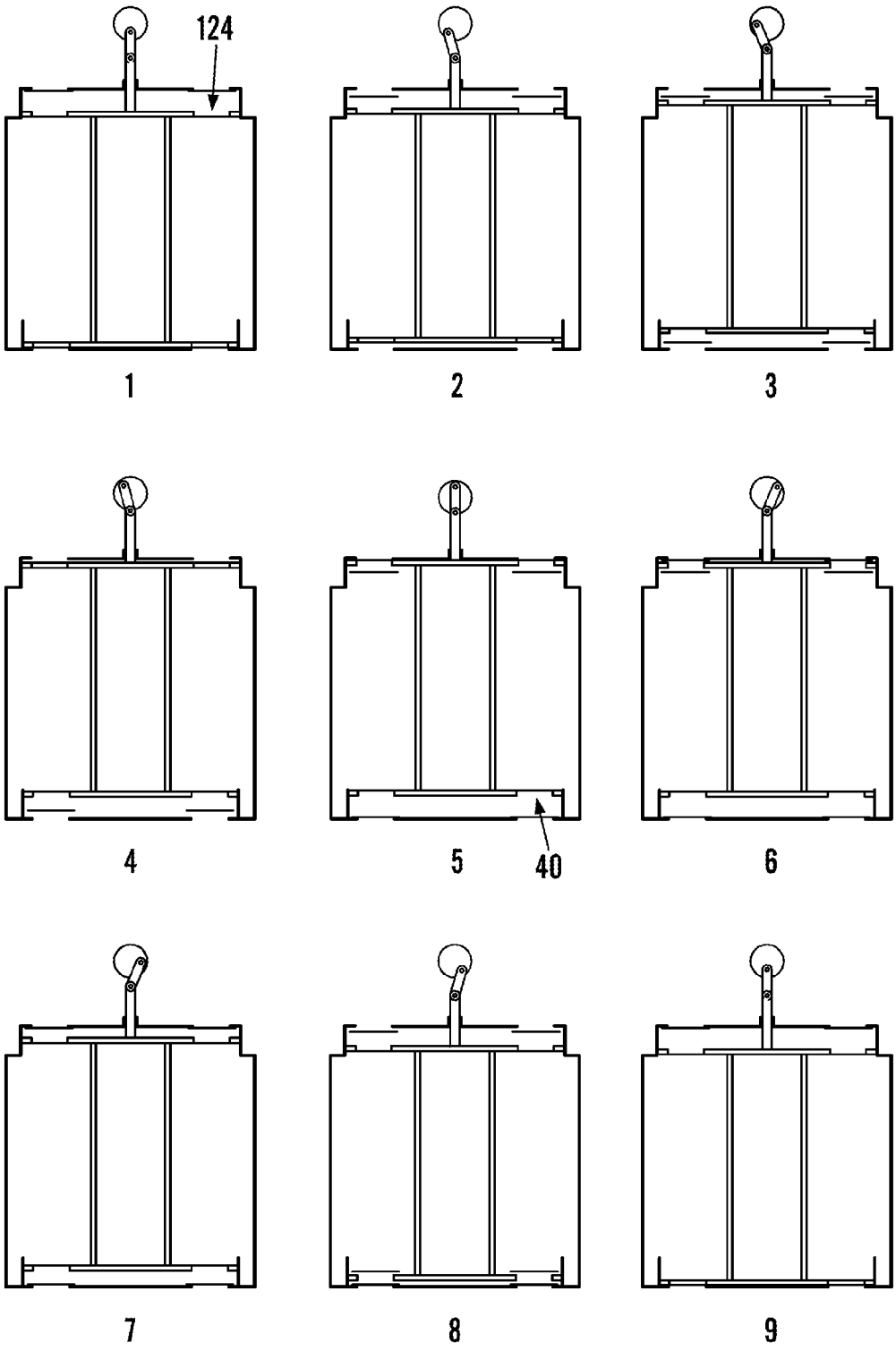
FIG. 2 shows a series of schematic views of the heat pump of FIG. 1 in various stages in a heat pump cycle.

In FIG. 2, heat pump 10 is shown with the driving mechanism 64 at eight sequential "crank" positions (each at 45 degree increments) during a heat pump cycle. The heat exchange unit and the bubble screen have been omitted for the sake of clarity. The various positions are described as follows (paragraph numbers refer to diagram numbers):

1: Crank (of driving mechanism 64) at bottom dead centre. All valves are closed, piston assembly is about to start to move upwards.

2: Piston assembly is in upward motion, exhaust valves 104 (at top of assembly) are open, and inlet valve 34 (at bottom of assembly) is open. Approximately zero pressure difference across the assembly as both expansion and compression chambers 124,40 are vented to atmosphere. Expansion chamber 124 is emptying to atmosphere, compression chamber 40 is receiving fresh charge of atmospheric air.

3: Mid stroke, piston assembly moving upwards, expansion chamber 124 half evacuated, compression chamber 40 half filled with fresh charge of atmospheric air. Valve positions as at stage 2.

4: Crank approaching top dead centre. Exhaust valve 104 is closing. Expansion inlet valve 128 (on lower face of expansion piston) is about to open. Inlet valve 34 is closing.

5: Top dead centre. Expansion inlet valve 128 is open and admitting pressurised processed air which has been cooled by the heat exchanger means 80 within the inter-piston space as it passes from inter-piston space to expansion chamber 124. Compression chamber valves are closed. Exhaust valve 104 is closed.

6: Crank no longer at top dead centre. Piston assembly descending. Expansion inlet valve 128 closing. Compression chamber valves closed, air in compression space being compressed, compression assisted by pressurised expansion chamber via inter-piston struts and hence recovering some of the previous compression energy. Exhaust valve 104 is closed.

7: Mid stroke, piston assembly descending. Expansion chamber valves now closed, air in expansion space expanding and performing work on piston, this work transmitted to the compression piston via the inter-piston struts. All compression chamber valves closed and air in the compression chamber is being compressed.

8: Approaching bottom dead centre. Air in expansion chamber 124 is now below atmospheric temperature and atmospheric specific volume, the exhaust valve 104 being only lightly retained against its seat by a spring or similar (not shown) now opens and allows some air at atmospheric pressure to re-enter the expansion chamber 124 such that for the remainder of the down stroke the expansion chamber 124 pressure remains roughly atmospheric. The delivery valve 68 now opens as the pressure difference between the inter-piston space and the compression piston has equalised. Compressed, warm air transfers from the compression chamber 40 to the inter-piston space ready to transfer energy to the load via the heat exchanger means 80.

9: Crank at bottom dead centre again. All valves closed, piston assembly about to start to move upwards.

In the operation described above, it should be noted that:

a) only one of valves 34 and 68 on the compression side is open at a time and when a valve opens the pressure on each side is approximately equal;

b) only one of valves 128 and 104 on the expansion side is open at a time and when a valve opens the pressure on each side is also approximately equal.

The expansion chamber is initially pressurised by closing the exhaust valve just prior to top dead centre (TDC), this gives a pre-compression to the level of the heat exchange chamber and equalises the pressures either side of the expansion chamber inlet valve at which point the valve actuator, which is sprung and was compressed during the upstroke, pushes it away from its seat. As the piston moves away from the cylinder head the valve loses contact with the valve actuator when the latter runs out of travel and this closes the valve. Setting the travel of the actuator thus controls the expansion ratio and, since the compression is simply via automatic valves to the heat exchange space, also the pressure within that space. The control of roughly constant pressure in the heat exchange space is very simple, since as the heat exchange space has about 15 to 20 times as much volume as the volumetric flow per cycle, the pressure fluctuations are low.

Expansion Chamber Valve Operation:

The expansion chamber valve operates as a form of airlock that is cycling air between two pressures. The purpose of the expansion chamber is to get the pressurised (cool) air from the heat exchanger back to atmospheric pressure with minimal aerodynamic losses before exhausting the gas. This means i) taking in a charge of pressurised heat exchanger air ii) decompressing it to atmospheric pressure iii) expelling most of this charge to the atmosphere iv) BUT leaving just enough air in the cylinder to re-pressurise it back to heat exchanger pressure v) Then taking in another charge of pressurised heat exchanger air and repeating the cycle.

The compression piston adds a FIXED MASS of gas to the heat exchanger during each stroke. The only variable is the pressure at which it is added and consequently the amount of work that needs to be done on the gas to get it to that pressure.

The timing of the closure of the expansion inlet valve determines the VOLUME of compressed air that is left in the chamber to be expanded. Essentially the pressure in the heat exchange space will continue to rise until the MASS of gas being expanded and expelled EACH STROKE is EQUAL to that ENTERING.

If a REDUCTION in PRESSURE is required, the expansion inlet valve is allowed to CLOSE LATER and the VOLUME to be INCREASED.

If an INCREASE in PRESSURE is required, the expansion inlet valve is allowed to CLOSE EARLIER and the VOLUME to be DECREASED.

However, the expansion inlet valve must not be allowed to close so late that the mass of gas is so large that the pressure inside the expansion chamber never drops to ambient, even at Bottom Dead Centre (BDC).

This one single control determines the pressure of the whole system and the temperature reached inside the heat exchanger. The actual temperature is additionally a function of inlet gas temperature, but an increase in temperature inside the heat exchanger may be achieved by raising the pressure of the system.

A summary of the steps involved in the operation of the expansion chamber valve (as the expansion piston moves from position BDC through position 2, to position 3 TDC, and then from position 3 through position 4 back to position 1 BDC) is provided below:

Exhaust Valve Opens and then Expanded Gas being Expelled from Expansion Chamber

| Heat Pump Expansion 1 | |
|---|---|
| Piston Position | 1 (Bottom Dead Centre) |
| Piston Direction | stationary |
| Expansion inlet valve closed | |
| Exhaust valve | open |
| Expansion chamber | ambient pressure |

| Heat Pump Expansion 2 | |
|---|---|
| Piston Position | moving from 1 to 2 |
| Piston Direction | moving up |
| Expansion inlet valve closed | |
| Exhaust valve | open |
| Expansion chamber | ambient pressure |

| Heat Pump Expansion 3 | |
|---|---|
| Piston Position | arriving at 2 |
| Piston Direction | moving up |
| Expansion inlet valve closed | |
| Exhaust valve | open |
| Expansion chamber | ambient pressure |

Exhaust Valve Closes to Allow Remaining Gas to be Recompressed to Heat Exchanger Pressure

| Heat Pump Expansion 4 | |
|---|---|
| Piston Position | 2 |
| Piston Direction | moving up |
| Expansion inlet valve closed | |
| Exhaust valve | closed |
| Expansion chamber | ambient pressure |

| Heat Pump Expansion 5 | |
|---|---|
| Piston Position | moving from 2 to 3 |
| Piston Direction | moving up |
| Expansion inlet valve closed | |
| Exhaust valve | closed |
| Expansion chamber | rising from ambient pressure to heat exchanger pressure |

In Order to Allow Expansion Inlet Valve to Open and Connect Heat Exchanger Space and the Expansion Space

| Heat Pump Expansion 6 | |
|---|---|
| Piston Position | moving from 2 to 3 |
| Piston Direction | moving up |
| Expansion inlet valve open | |
| Exhaust valve | closed |
| Expansion chamber | heat exchanger pressure |

| Heat Pump Expansion 7 | |
|---|---|
| Piston Position | 3 (Top Dead Centre) |
| Piston Direction | stationary |
| Expansion inlet valve open | |
| Exhaust valve | closed |
| Expansion chamber | heat exchanger pressure |

And then to Allow a New Charge of Compressed Gas to Pass from The Heat Exchange Space to the Expansion Space

| Heat Pump Expansion 8 | |
|---|---|
| Piston Position | moving from 3 to 4 |
| Piston Direction | moving down |
| Expansion inlet valve open | |
| Exhaust valve | closed |
| Expansion chamber | heat exchanger pressure |

| Heat Pump Expansion 9 | |
|---|---|
| Piston Position | arriving at 4 |
| Piston Direction | moving down |
| Expansion inlet valve open | |
| Exhaust valve | closed |
| Expansion chamber | heat exchanger pressure |

This Exact Charge of Gas being Determined by the Forced Closure of the Expansion Inlet Valve

| Heat Pump Expansion 10 | |
|---|---|
| Piston Position | 4 |
| Piston Direction | moving down |
| Expansion inlet valve closed | |
| Exhaust valve | closed |
| Expansion chamber | dropping from heat exchanger pressure to ambient pressure |

This Charge of Gas then being Expanded Back to Ambient Pressure

| Heat Pump Expansion 11 | |
|---|---|
| Piston Position | moving from 4 to 1 |
| Piston Direction | moving down |
| Expansion inlet valve closed | |
| Exhaust valve | closed |
| Expansion chamber | dropping from heat exchanger pressure to ambient pressure |

| Heat Pump Expansion 12 | |
|---|---|
| Piston Position | moving from 4 to 1 |
| Piston Direction | moving down |
| Expansion inlet valve closed | |
| Exhaust valve | closed |
| Expansion chamber | dropping from heat exchanger pressure to ambient pressure |

Figure 4:
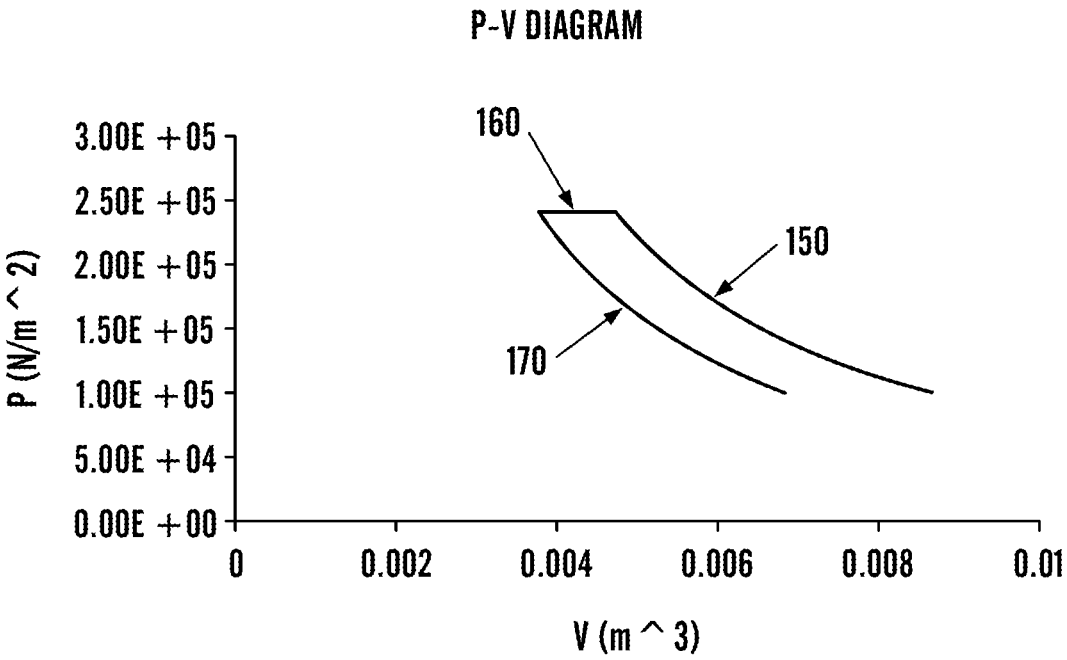
FIG. 4 shows a P-V diagram modelling a typical cycle of the pump of FIG. 1.

FIG. 4 shows an idealised P-V (pressure plotted against volume) diagram for heat pump 10. Curve 150 at the right-hand side of the diagram represents an isentropic compression from ambient temperature and pressure; the straight portion 160 represents isobaric cooling of the flow as it passes through the heat exchanger means 80; and curve 170 at the left-hand side of the diagram represents an isentropic expansion back to atmospheric pressure. Of course, the real P-V diagram is likely to exhibit some differences from the idealized cycle due to irreversible processes occurring within the real cycle.

Using the idealized cycle depicted in the P-V diagram of FIG. 3, the following performance figures are predicted:

| | | |
|---|---|---|
| Energy of ingested air = | 2195 | J |
| Energy of exhausted air = | 1736 | J |
| Work done by atmosphere on exhaust gas = | 184 | J |
| Energy pumped to load = | 825 | J |
| Energy input = | 182 | J |
| Coefficient of Performance = | 4.54 | J |

In the above example, the heat pump 10 is assumed to have a compression and expansion cylinder diameter of 0.6 m operating at 800 cycles per minute and delivering 11 kw to the load for an input of 2.423 kw of mechanical power. It is assumed that the load is heated to 90 degrees Celsius from an initial 10 degrees Celsius with an assumed heat exchanger effectiveness of 90%, and that the exhaust gas (air in this example) is ejected at a temperature of −49 degrees Celsius.

The example above represents a change in load fluid temperature of 80 degrees Celsius. As the load fluid is warmed such that the initial temperature is above the original value (as would occur in a circulating heating system flow) the working gas flow is cooled to a lesser degree by the load fluid, this results in more work being available for the expansion stage which reduces the input work per cycle although the coefficient of performance remains largely unchanged. In the extreme situation that the load is initially at the same temperature as the gas flow leaving the compressor stage, no thermal work is done on the load and all the energy added to the gas by the compression is available for expansion. The energy recovered by the expansion in this case for the idealised cycle would exactly equal the energy of compression and hence no mechanical work would be needed to drive the device. This is obviously only true for an idealised frictionless, lossless system but is used to illustrate that the idealised coefficient of performance is only a function of the temperature difference between the input ambient working gas and the peak temperature of the load fluid. This temperature difference is controlled by the compression and expansion ratio, since the compression valving may be automatic (e.g. driven by pressure differentials) the pressure ratio of the device and hence the temperature of the output may be entirely controlled by the timing of the inlet valve of the expansion stage.

It may be further noted that losses within the real cycle within the compressor and due, for example, to forcing the flow through the foramenous screen will be manifested as heat that can be extracted by the load fluid. The only point at which energy losses may not be accessed by the load fluid is between the inlet to the expansion stage and once the gas has vacated the heat exchanger means. If the driving mechanism/motive power source generates waste heat even this can be utilised by causing the inlet flow to also be the cooling flow for the driving system. Losses within the system below the level of the expander inlet will thus reduce the coefficient of performance (COP) but will still result in useful heating of the load fluid.

Figure 5:
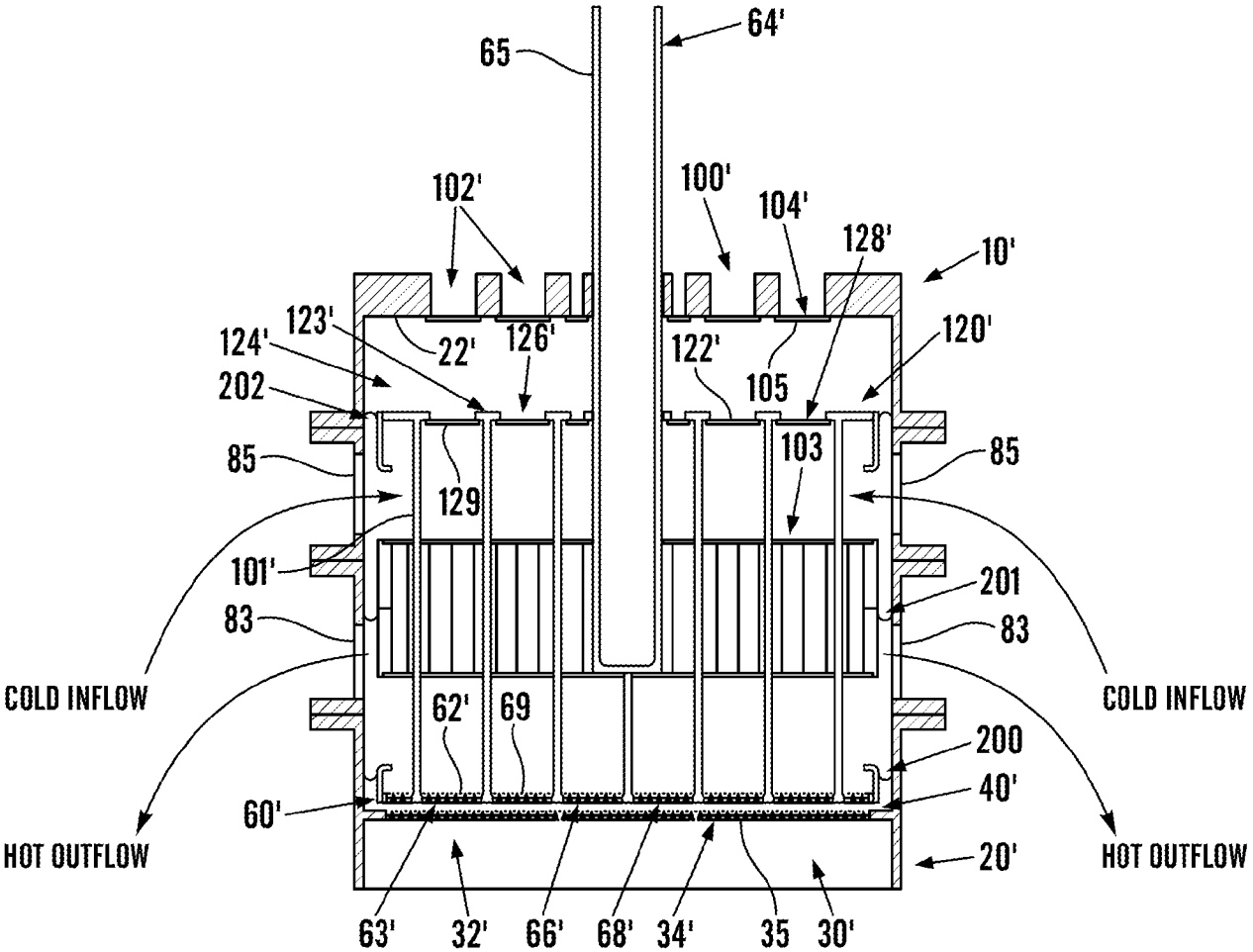
FIG. 5 shows a schematic cross-sectional view of a second heat pump embodying the present invention.

FIG. 5 shows a heat pump 10' comprising a body 20' including: inlet means 30'; a compression chamber 40'; compression means 60'; heat exchanger means (not shown); an expansion chamber 124'; expansion means 120'; and exhaust means 100'.

Inlet means 30' comprises a plurality of inlet apertures 32' each having a corresponding ball inlet valve 34'. Each ball inlet valve 34' comprises a ball 35 constrained to move in a passageway connected to a respective inlet aperture 32'. When pressure in the compression chamber 40' is greater than atmospheric, each ball 35 is urged against its respective inlet aperture 32' to provide a seal. When pressure in the compression chamber 40' drops to atmospheric, balls 35 are free to move away from their respective inlet apertures 32' to allow ingress of air.

Compression means 60' comprises a single compression piston 62' coupled to a driving mechanism 64'. Compression piston 62' is slidably mounted in compression chamber 40' and configured to compress gas contained therein. Compression piston 62' has a piston face 63' including a plurality of apertures 66' each having a corresponding ball delivery valve 68' disposed on a top surface thereof for controlling gas flow through the piston apertures 66'. Each ball delivery valve 68' comprises a ball 69 constrained to move in a passageway connected to a respective aperture 66'. When pressure in the compression chamber 40' is below that in the heat exchanger means, each ball 69 is urged against its respective aperture 66' to provide a seal. When the pressure on both sides of the piston face 63' equalises, balls 34 are free to move from their respective apertures 66' to allow compressed gas to pass through the piston face 63'.

In use, air entering the heat pump 10' via inlet means 30' is allowed to pass into the compression chamber 40'. Once air has entered the compression chamber 40', the inlet apertures 32' are sealed by ball inlet valve 34' as the compression piston 62' is actuated (with piston apertures 66' sealed by gas pressure within the heat exchange means 80') by driving mechanism 64'. Once air contained in the compression chamber has been compressed by the compression means 60', the gas is transferred to heat exchanger means (not shown) via outlets 83 when ball delivery valves 68' open automatically. Heat energy and water vapour are removed from the compressed gas in the heat exchange means (not shown) before the gas is passed to expansion chamber 124' (via inlets 85) for further processing by the expansion means 120'. Moveable seals 200, 201 and 202 are provided to ensure gas passes through each stage of the heat pump.

Figure 6A:
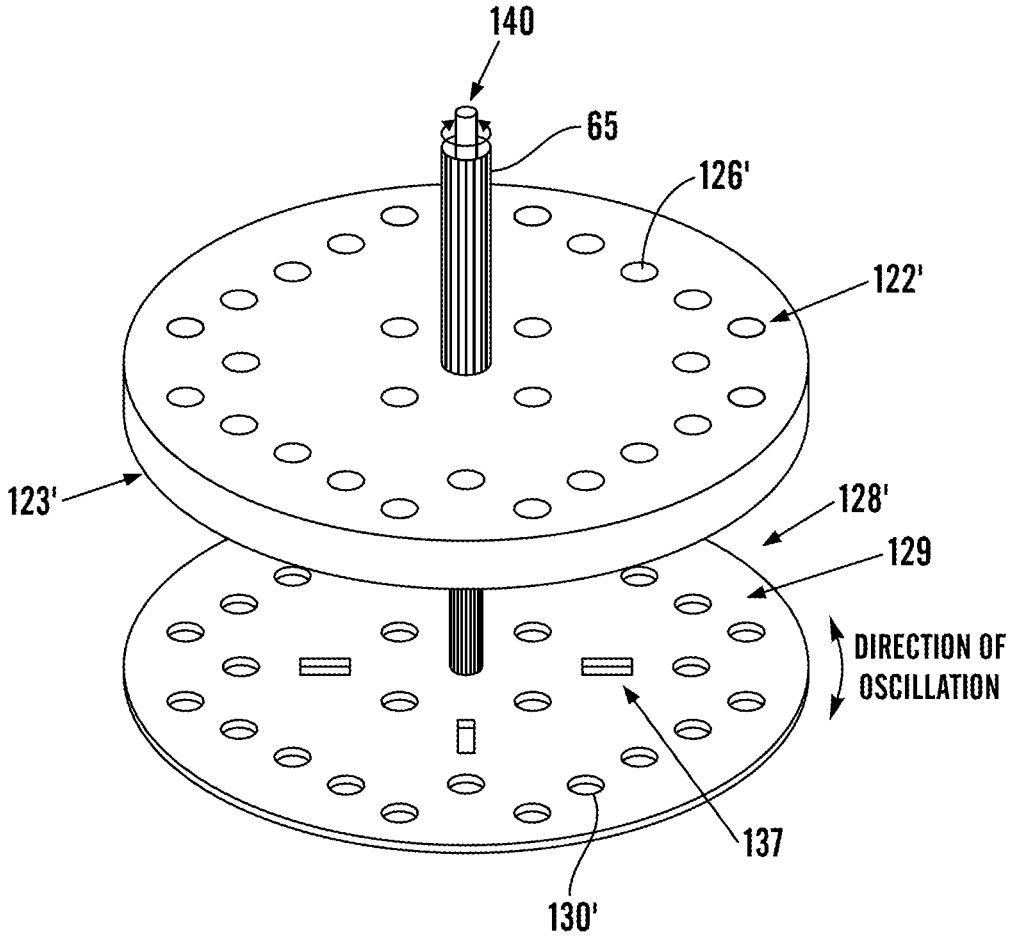
FIG. 6A shows schematic details of a piston and rotary valve deployed in the heat pump of FIG. 5.
Figure 6B:
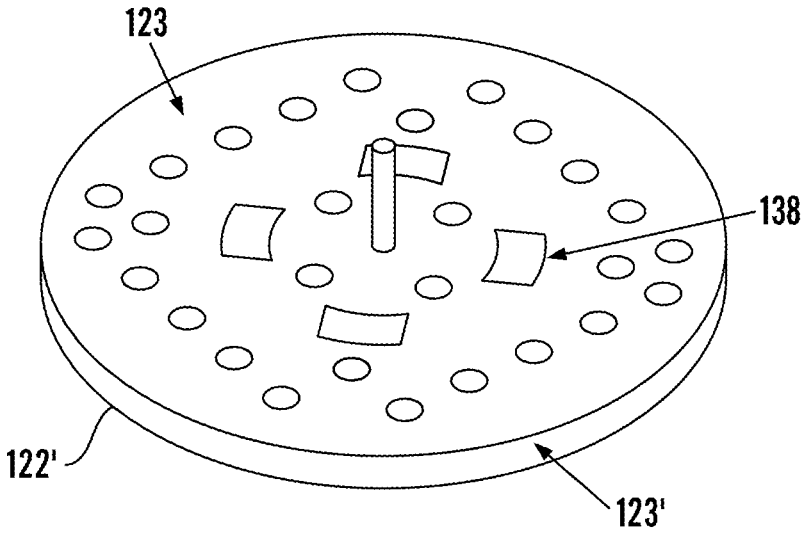
FIG. 6B shows an underside view of the piston shown in FIG. 6A.
Figure 6C:
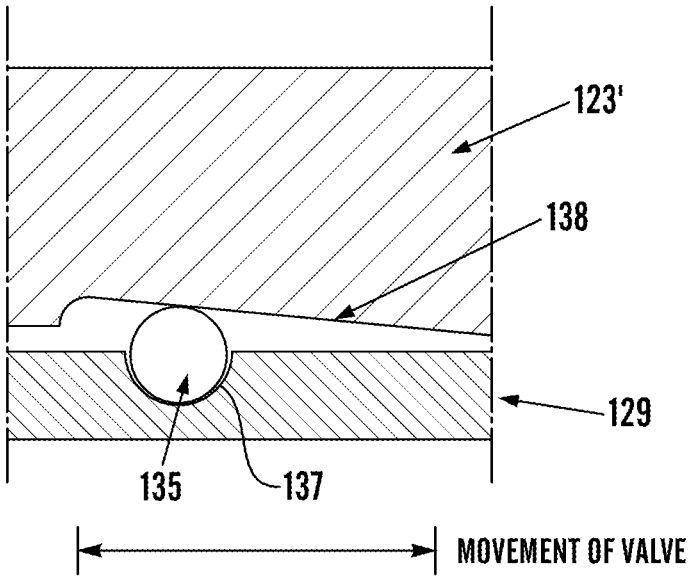
FIG. 6C shows a schematic cross-sectional view of the piston and rotary valve shown in FIG. 6A.

Expansion means 120' comprises an expansion piston 122', rigidly coupled to compression piston 62' by means of lightweight interconnecting struts 101', and slidably mounted in expansion chamber 124'. A lightweight stiffening structure (or "structural piston core") 103 is coupled to struts 101' to provide increased rigidity. Expansion piston 122' has a piston face 123' comprising a plurality of apertures 126' and a rotary expansion inlet valve 128' disposed on a underside thereof for controlling gas flow through the expansion piston apertures 126'. Rotary expansion inlet valve 128' comprises a circular plate 129 including a plurality of apertures 130' which are registrable with apertures 126' on the piston face 123' and a plurality of arcuate grooves (not illustrated) each for receiving and allowing oscillation of a respective interconnecting strut 101'. The circular plate 129 is rotatably mounted to the piston face 123' and rotatable from a first position in which apertures 126' and 130' are registered to a second position in which all apertures 126' and 130' are not registered to any degree. In the second position, the circular plate 129 is urged against the piston face 123' to seal apertures 122'. As can be seen from FIGS. 6A-6C, the circular plate 129 comprises a plurality of roller bearings 135 each mounted in a respective grooves 137 in the circular plate 129. Piston face 123' comprises a plurality of tapered (or cam-shaped) grooves 138 each for receiving a corresponding roller bearing 135. The tapered grooves 138 and grooves 137 are configured to fully receive the roller bearings 135 when the circular plate is in the second position. As the circular plate 129 rotates from the second position to the first position, the profile of the tapered grooves 138 decreases in depth causing the circular plate 129 and piston face 123' to separate. The circular plate 129 is rotated by means of a first rotatable actuator 140 housed within drive shaft 65 of the driving mechanism 64'. The circular plate 129 may be biased in the second position (e.g. by a spring coupled to the first rotatable actuator).

Exhaust means 100' comprises a plurality of outlet apertures 102' and a rotary exhaust valve 104'. Rotary exhaust valve 104' comprises a circular plate 105 including a plurality of apertures (not shown) which are registrable with outlet apertures 102'. The circular plate 105 is rotatably mounted to an underside face 22' of body 20' and is rotatable from a first position in which the apertures in the circular plate 105 and outlet apertures 102' are registered to a second position in which the apertures are no longer registered to any degree. In the second position, the circular plate 105 is urged against the underside face 22' of the body 20' to seal apertures 102'. The form and operation of the rotary expansion inlet valve 104' corresponds to that of the rotary expansion inlet valve 128' discussed above. The circular plate 105 is rotated by means of a second rotatable actuator (not shown). The circular plate 105 may be biased in the second position (e.g. by a spring coupled to the second rotatable actuator).

Certain modifications may be made to the heat pumps 10 and 10'. For example, the drive shaft may enter the body through its base. The compression stage may occur at the top of the body and the expansion stage at the bottom. The air flow can also be reversed so that ambient air comes in and out from the side of the body, with compressed air going out from the top and bottom of the body. In addition, the compression and expansion pistons can be separated and operated independently. For example, a heat pump may be provided comprising a single compression piston housed in a single compression chamber (with one side of the piston face vented to atmosphere) and a single expansion piston housed in a single expansion chamber (with one side of the piston face vented to atmosphere). Alternatively, twin compression chambers may be provided to allow both sides of the piston face to be used to compress gas and/or twin expansion chambers may be provided to allow both sides of the expansion piston face to be used to expand gas.

ANNEX

Advantages of the Present Invention

A difficult problem for many heat pump systems is the accretion of ice on the cold side of the unit. A heat pump made in accordance with the present invention is likely to be resistant to icing problems since moisture-bearing air entering the heat pump will be above, or in the worst case of freezing fog slightly below, ambient freezing conditions. Compression within the heat pump should raise the temperature well above the freezing level and cooling of the pressurised flow by the load will result in the water condensing within the unit as a liquid from where is may be ejected as a liquid. The gas flow entering the expander will then be very dry by comparison with the input flow and hence ice formation should be limited. A further benefit of the present invention is that the heat of vaporisation of the moisture extracted from the flow will be available to the load.

In conclusion, the present invention offers a heat pump with a high potential coefficient of performance where most of the likely mechanical and thermal losses will result in thermal energy available to the load. The installation costs in a domestic environment are likely to be very low and probably equivalent to the installation of a simple boiler. Common problems associated with heat pump such as large and remote heat collection installations and ice accretion are alleviated, perhaps even avoided, by the intrinsic nature of the present invention.

Valving Arrangements for Compression Stage.

For a high COP it is essential to have the following air flow characteristics:

i) Low aerodynamic losses i.e. Low air flow rate
ii) High Mass flow rate of Air
iii) Large area for air flow when valves open When a short piston stroke to piston diameter arrangement is used, a large piston face is available but only a small area of cylinder wall. This means it is better to provide valving directly through the piston faces.

The compression valves may be self-actuating and consequently may be simple to operate. Possible choices of valves include:

i) Plate valves
ii) Multiple Ball valves
iii) Reed Valves

For higher running speeds it may be necessary to actuate these valves, in which case they will need to be designed along the same lines as the expansion valves.

Valving Arrangements for Expansion Stage.

For a high COP it is essential to have the following air flow characteristics:

i) Low aerodynamic losses ie Low air flow rate
ii) High Mass flow rate of Air
iii) Large area for air flow when valves open When a short piston stroke to piston diameter arrangement is used, it is again better to provide valving directly through the piston faces.

The expansion valves need to be physically actuated (mechanical, pressure or electrical/electronic). They can be:

i) Plate valves
ii) (Intermittent) Rotary Valves.

What is claimed is:

1. Apparatus for use as a heat pump comprising:
a compression chamber;
an inlet for allowing gas to enter the compression chamber;
a compression piston stage comprising a compression piston for compressing gas contained in the compression chamber;
a heat exchanger for receiving thermal energy from gas compressed by the compression piston;
an expansion chamber for receiving gas after exposure to the heat exchanger;
an expansion piston stage comprising an expansion piston for expanding gas received in the expansion chamber; and
an exhaust for venting gas from the expansion chamber after expansion thereof;
wherein the expansion piston is moveable between a first position and a second position, with expansion of gas contained in the expansion chamber occurring as the gas does work to help move the expansion piston from the first position to the second position; and
wherein the expansion piston comprises an expansion piston aperture located on a working face of the expansion piston and having an expansion valve for allowing gas to pass through the expansion piston.

2. Apparatus according to claim 1, wherein the expansion valve is a physically actuated expansion valve.

3. Apparatus according to claim 1, wherein the expansion valve comprises a plurality of expansion piston apertures located on a working face of the expansion piston and a valve for controlling gas flow through the expansion piston apertures.

4. Apparatus according to claim 1, wherein the expansion valve is an expansion inlet valve for allowing gas to pass through the expansion piston from the heat exchanger to the expansion chamber.

5. Apparatus according to claim 4, wherein the expansion inlet valve is configured to allow gas to flow through the expansion piston aperture as the expansion piston moves into the first position.

6. Apparatus according to claim 4, wherein the expansion inlet valve is selected from the group of: a plate valve; and a rotary valve.

7. Apparatus according to claim 1, wherein the expansion valve is an expansion exhaust valve for allowing gas to pass through the expansion piston for venting gas from the expansion chamber.

8. Apparatus according to claim 1, wherein the expansion piston stage has an effective piston diameter to piston stroke length ratio of at least 2:1.

9. Apparatus according to claim 1, wherein the expansion piston stage has an effective piston diameter to piston stroke length ratio of at least 3:1.

10. Apparatus according to claim 1, wherein the expansion piston stage has an effective piston diameter to piston stroke length ratio of at least 4:1.

11. Apparatus for use as a heat pump comprising:

a compression piston assembly;

an inlet for allowing gas to enter the compression piston assembly;

a heat exchanger for receiving thermal energy from gas compressed by the compression piston assembly;

an expansion piston assembly for receiving gas after exposure to the heat exchanger; and exhaust means for venting gas from the expansion piston assembly after expansion thereof;

wherein at least one of the compression piston assembly and the expansion piston assembly comprises:

at least one piston; and a chamber for receiving the piston;

wherein the piston has an effective piston diameter to piston stroke length ratio of at least 2:1 and comprises a plurality of piston apertures located on a working face of the piston each with a delivery valve for allowing gas to pass through the piston.

12. Apparatus according to claim 11, wherein the effective piston diameter to piston stroke length ratio is at least 3:1.

13. Apparatus according to claim 11, wherein the effective piston diameter to piston stroke length ratio is at least 4:1.

14. Apparatus according to claim 11, wherein the at least one piston is a single piston.

15. Apparatus according to claim 11, wherein the gas is air.

16. Apparatus according to claim 11, which apparatus forms part of a refrigerator.

17. Apparatus according to claim 11, which apparatus forms part of a heat engine.

* * * * *